US010873815B2

(12) United States Patent
Zheng et al.

(10) Patent No.: US 10,873,815 B2
(45) Date of Patent: Dec. 22, 2020

(54) ELECTRET CONDENSER MICROPHONE WITH LOW NOISE FIGURE AND METHOD FOR PRODUCING THE SAME

(71) Applicant: Transound Electronics Co., Ltd., Dongguan (CN)

(72) Inventors: Huming Zheng, Dongguan (CN); Tseng-Feng Wen, Dongguan (CN); Yu Zhang, Dongguan (CN); Feng Tong, Dongguan (CN)

(73) Assignee: TRANSOUND ELECTRONICS CO., LTD., Dongguan (CN)

( * ) Notice: Subject to any disclaimer, the term of this patent is extended or adjusted under 35 U.S.C. 154(b) by 0 days.

(21) Appl. No.: 16/449,473

(22) Filed: Jun. 24, 2019

(65) Prior Publication Data

US 2020/0236468 A1 Jul. 23, 2020

(30) Foreign Application Priority Data

Jan. 23, 2019 (CN) ..... 2019 1 0063833

(51) Int. Cl.
*H04R 19/01* (2006.01)

(52) U.S. Cl.
CPC ..... *H04R 19/016* (2013.01)

(58) Field of Classification Search
CPC ..... H04R 19/016
USPC ..... 381/361, 369
See application file for complete search history.

(56) References Cited

U.S. PATENT DOCUMENTS

| | | | | |
|---|---|---|---|---|
| 7,239,714 | B2 * | 7/2007 | de Blok | H04R 19/016 381/174 |
| 2006/0067544 | A1 * | 3/2006 | Moraghan | H04R 25/502 381/113 |
| 2006/0177083 | A1 * | 8/2006 | Sjursen | H04R 25/60 381/322 |
| 2006/0177085 | A1 * | 8/2006 | Izuchi | H04R 1/086 381/369 |

OTHER PUBLICATIONS

Arie Van Rhijn, "Integrated Circuits for High Performance Electret Microphone", Mar. 22-25, 2003 (Year: 2003).*

* cited by examiner

*Primary Examiner* — Sunita Joshi
(74) *Attorney, Agent, or Firm* — Leong C. Lei

(57) ABSTRACT

An electret condenser microphone with a low noise figure and a method for producing the same are disclosed. An electret variable condenser is first installed into a housing, and then an ASIC amplifier and a printed circuit board are installed into the housing. The ASIC amplifier is electrically connected to the electret variable condenser. It reduces the noise figure effectively and ensures the normal transmission of the effective sound. In particular, it ensures the stability and reliability of the ASIC amplifier during use. The process is simple, the production efficiency is high, and the processing cost is low.

5 Claims, 7 Drawing Sheets

ELECTRET CONDENSER MICROPHONE WITH LOW NOISE FIGURE AND METHOD FOR PRODUCING THE SAME

BACKGROUND OF THE INVENTION

1. Field of the Invention

The present invention relates to an electret condenser microphone, and more particularly to an electret condenser microphone with a low noise figure and a method for producing the same.

2. Description of the Prior Art

A conventional electret condenser microphone (ECM) generally includes a diaphragm assembly, a back plate, and a printed circuit board. The printed circuit board is connected to a field-effect tube. When the diaphragm assembly encounters acoustic vibrations, the electric field of the capacitance is changed, thereby generating an alternating voltage that varies with changes in sound waves. In the conventional electret condenser microphone, the gate of the field-effect tube of the printed circuit board is directly connected to the back plate, the noise figure is large, and it is difficult to ensure the normal transmission of the effective sound.

Accordingly, the inventor of the present invention has devoted himself based on his many years of practical experiences to solve these problems.

SUMMARY OF THE INVENTION

In view of the shortcomings of the prior art, the primary object of the present invention is to provide an electret condenser microphone with a low noise figure and a method for producing the same. It reduces the noise figure effectively and ensures the normal transmission of the effective sound. In particular, it ensures the stability and reliability of an ASIC amplifier during use. The process is simple, the production efficiency is high, and the processing cost is low.

In order to achieve the above object, the present invention adopts the following technical solutions:

According to one aspect of the present invention, an electret condenser microphone is provided. The electret condenser microphone comprises a housing, an electret variable condenser, and an ASIC (application-specific integrated circuit) amplifier. The electret variable condenser and the ASIC amplifier are installed in the housing. The ASIC amplifier is mounted on a printed circuit board. An output terminal is disposed on the printed circuit board. The electret variable condenser is electrically connected to the ASIC amplifier. The ASIC amplifier is electrically connected to the output terminal on the printed circuit board.

According to another aspect of the present invention, a method for producing an electret condenser microphone is provided. The method comprises:

(1) a preparation step: preparing a housing, an electret variable condenser and an ASIC amplifier, wherein the ASIC amplifier is bonded to a printed circuit board by a COB (chip-on-board) technology;

(2) an assembly step: installing the electret variable condenser into the housing, and installing the ASIC amplifier and the printed circuit board into the housing, wherein the ASIC amplifier is electrically connected to the electret variable condenser.

Compared with the prior art, the present invention has obvious advantages and beneficial effects. Specifically, it mainly uses the ASIC amplifier instead of the existing field-effect tube, which reduces the noise figure effectively and ensures the normal transmission of the effective sound. In particular, the ASIC amplifier is bonded to the printed circuit board by a COB technology to ensure the stability and reliability of the ASIC amplifier during use. The process is simple, the production efficiency is high, and the processing cost is low.

Secondly, through the specific design of the conductive member, the back plate and the printed circuit board are elastically connected. On the one hand, it ensures the firm installation between the two, on the other hand, it avoids the attenuation and interference of the electric signal due to the wires, reduces the contact resistance, and improves the signal output efficiency effectively.

Furthermore, the overall structural design is smart and reasonable, and the assembly between the parts is convenient and firm, thereby ensuring the reliability and stability of the overall operation.

DETAILED DESCRIPTION OF THE PREFERRED EMBODIMENTS

Figure 1:
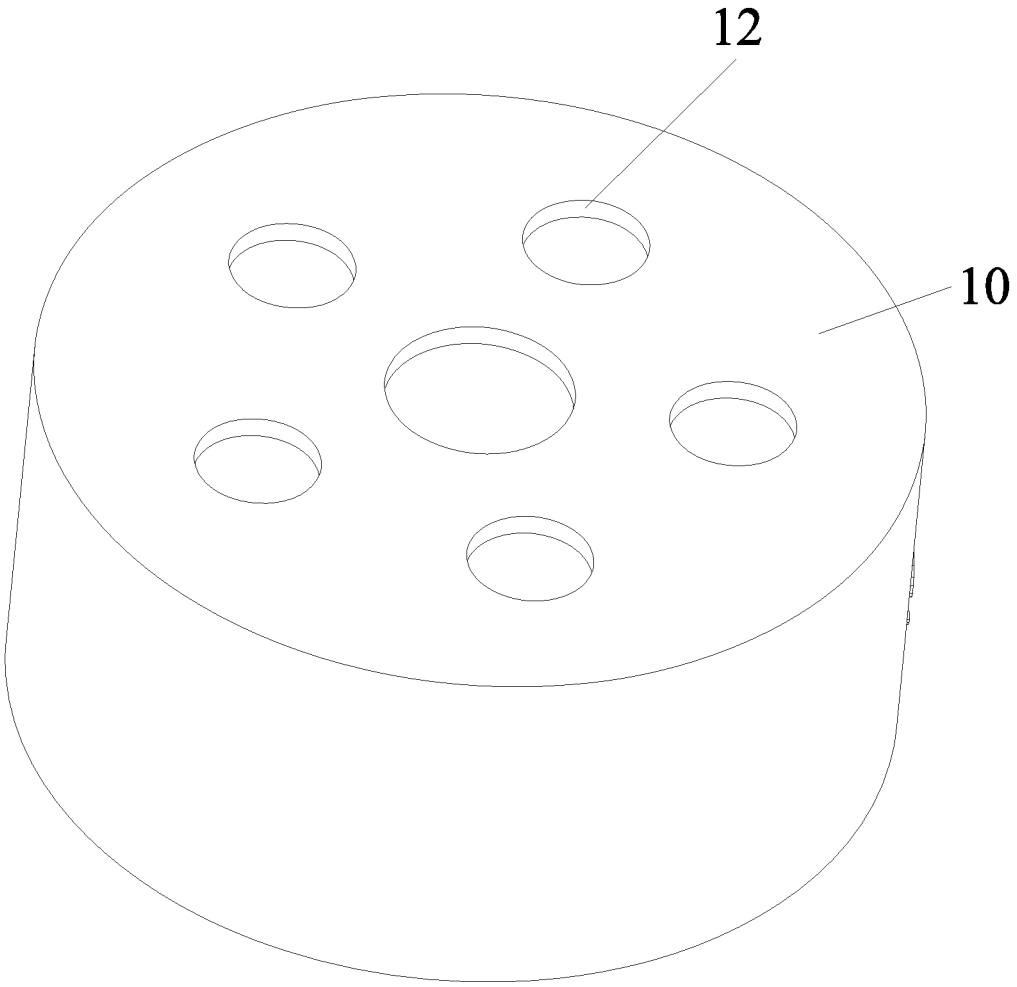
FIG. 1 is a perspective view in accordance with a preferred embodiment of the present invention.
Figure 2:
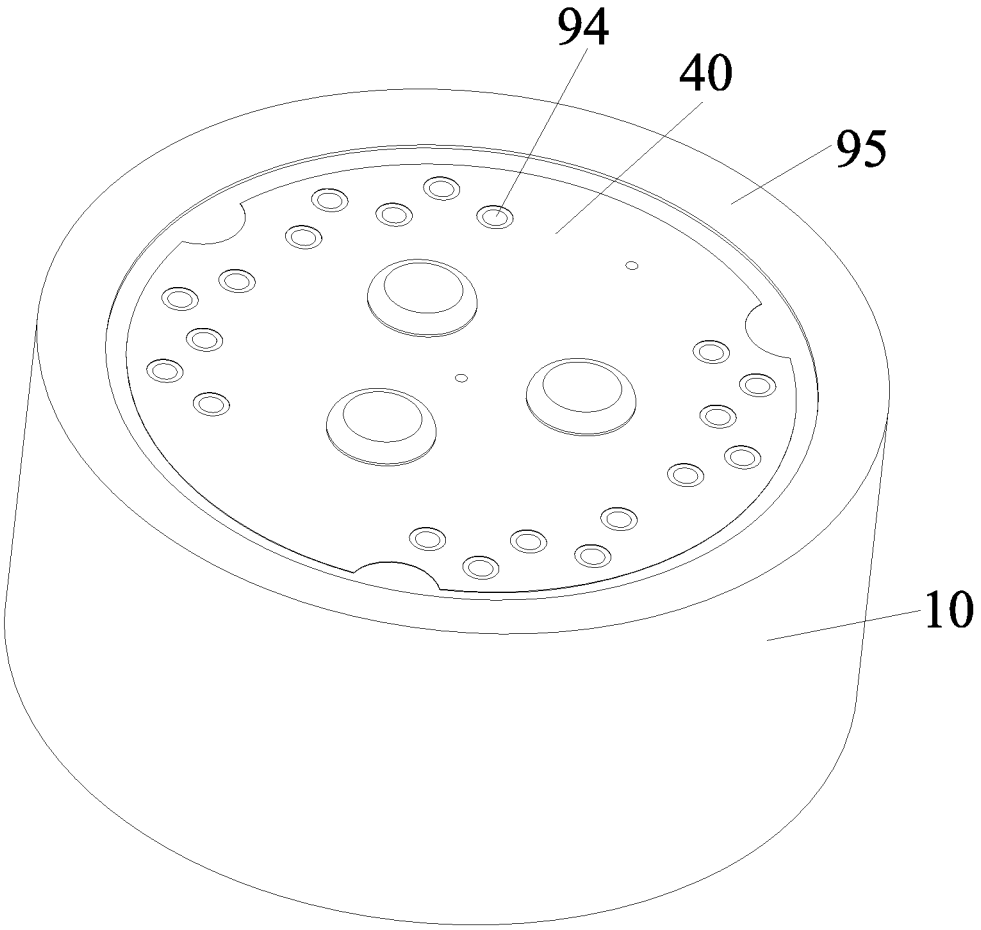
FIG. 2 is another perspective view in accordance with the preferred embodiment of the present invention.
Figure 3:
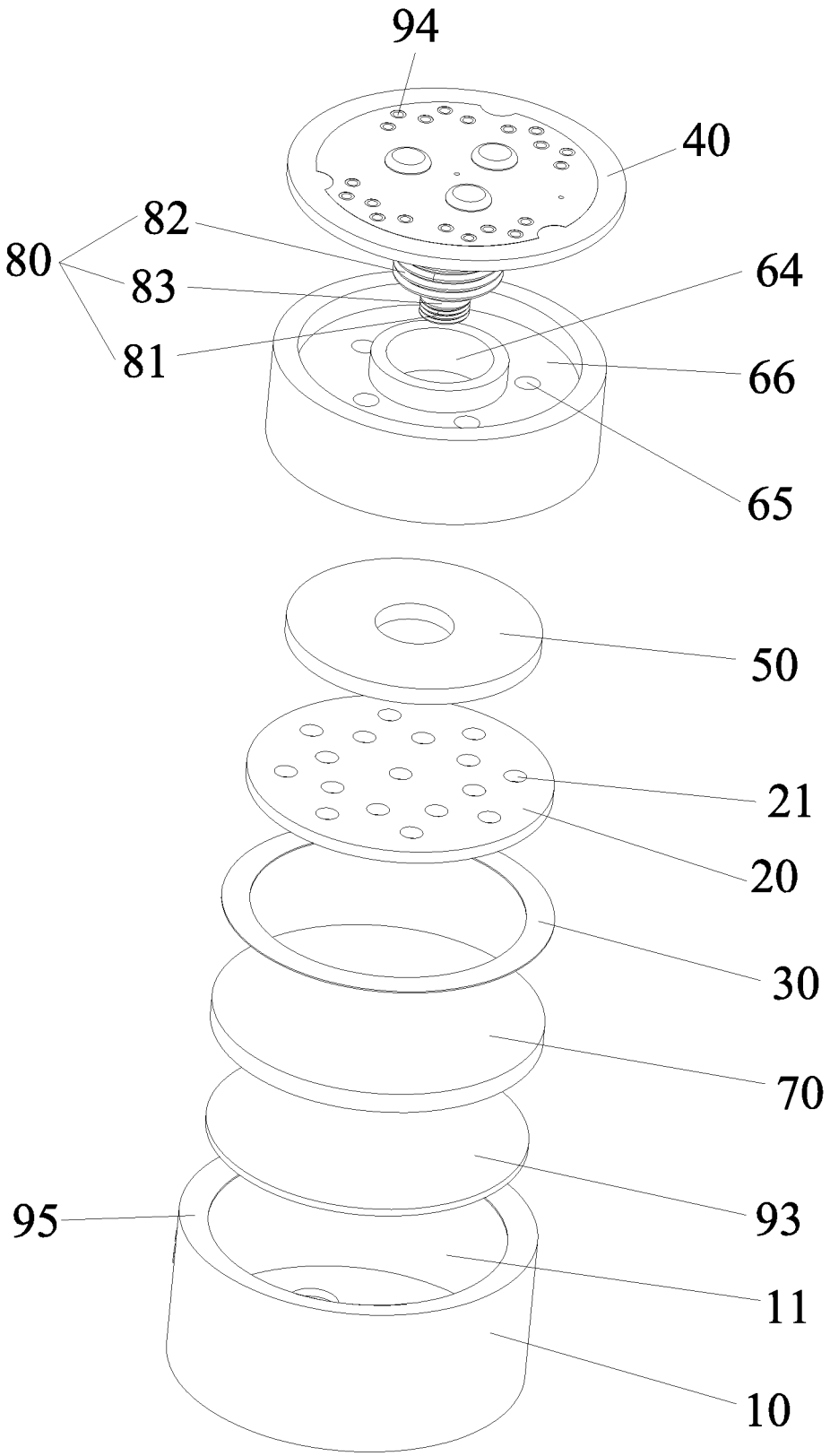
FIG. 3 is an exploded view in accordance with the preferred embodiment of the present invention.
Figure 4:
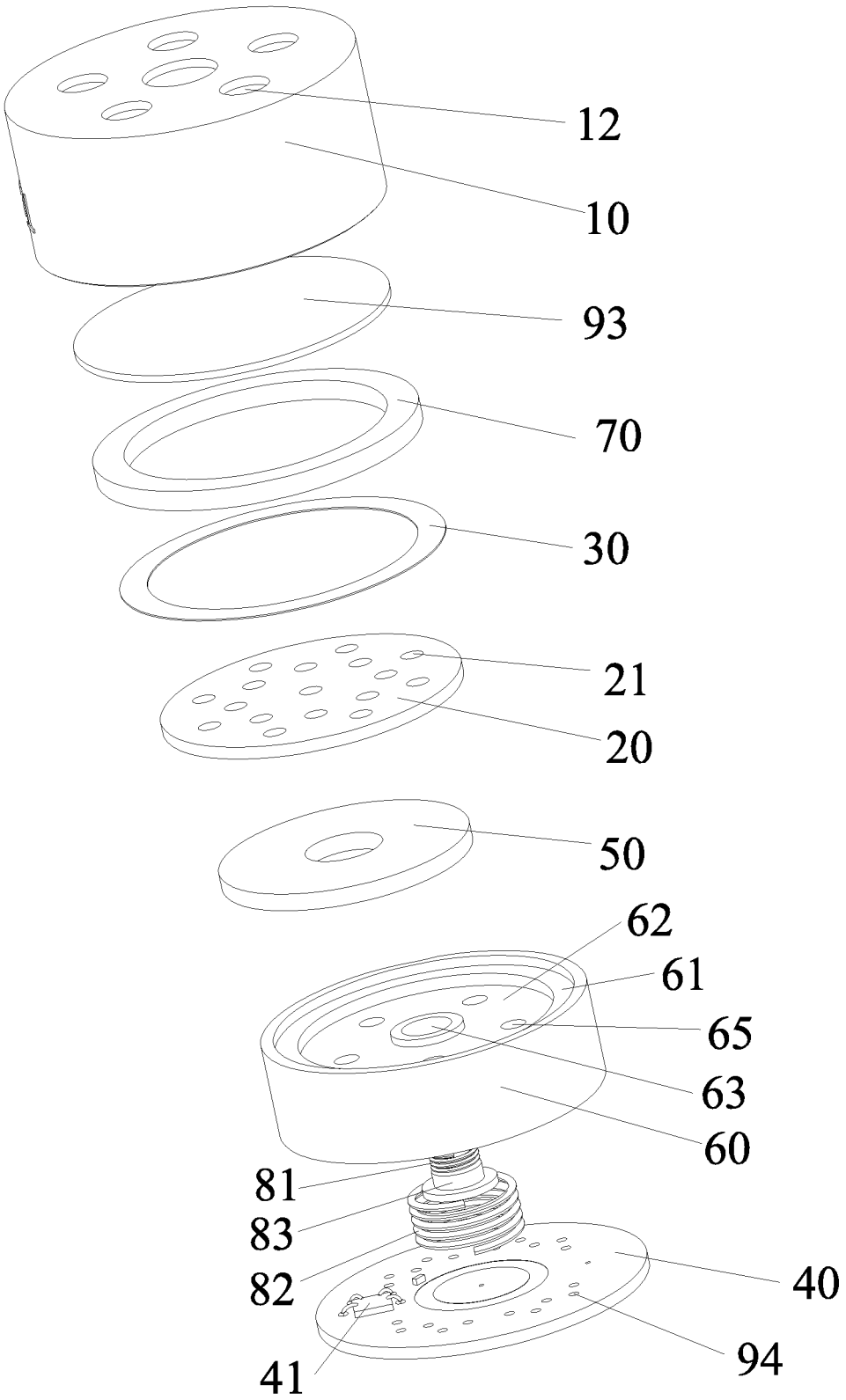
FIG. 4 is another exploded view in accordance with the preferred embodiment of the present invention.
Figure 5:
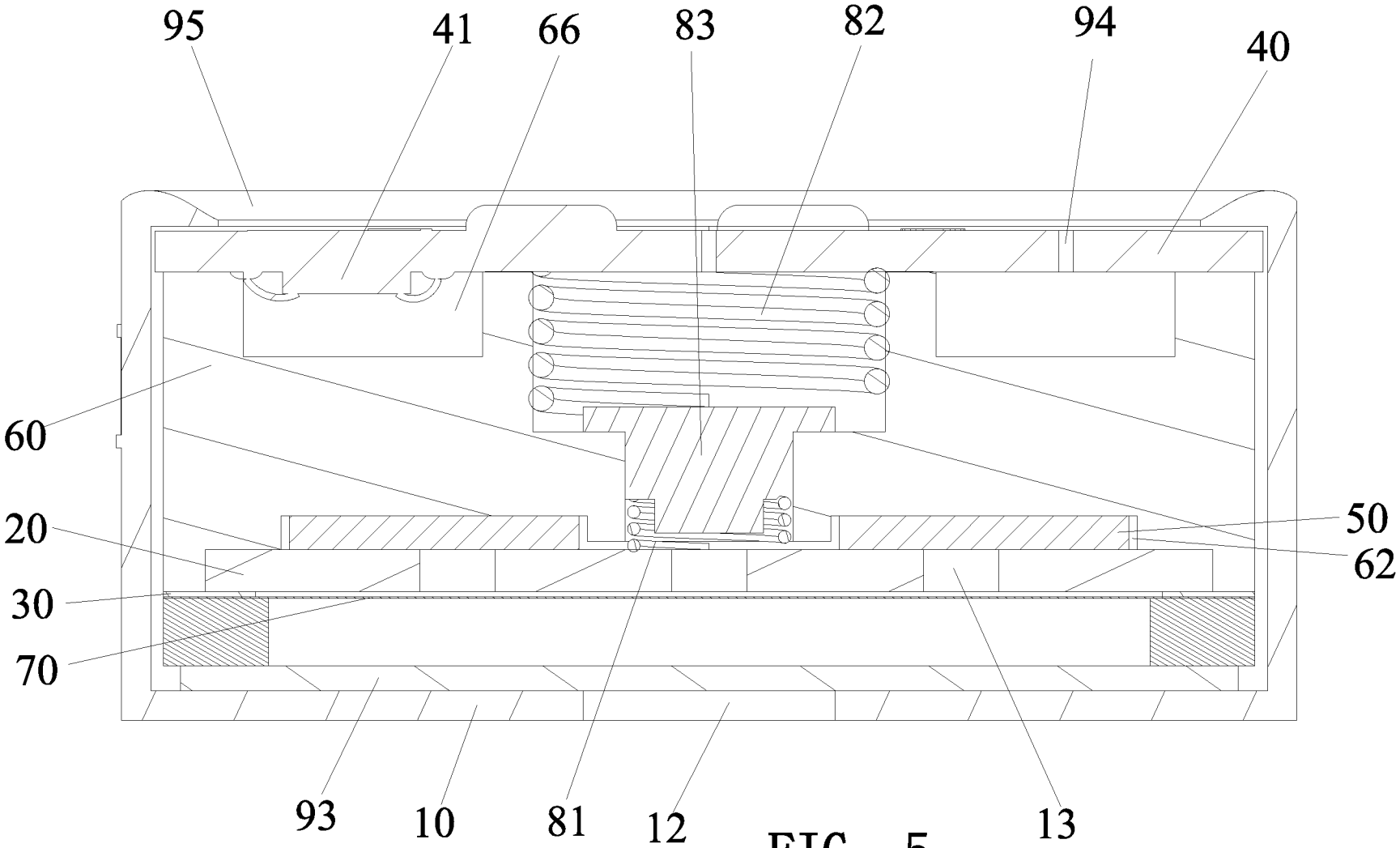
FIG. 5 is a cross-sectional view in accordance with the preferred embodiment of the present invention.
Figure 6:
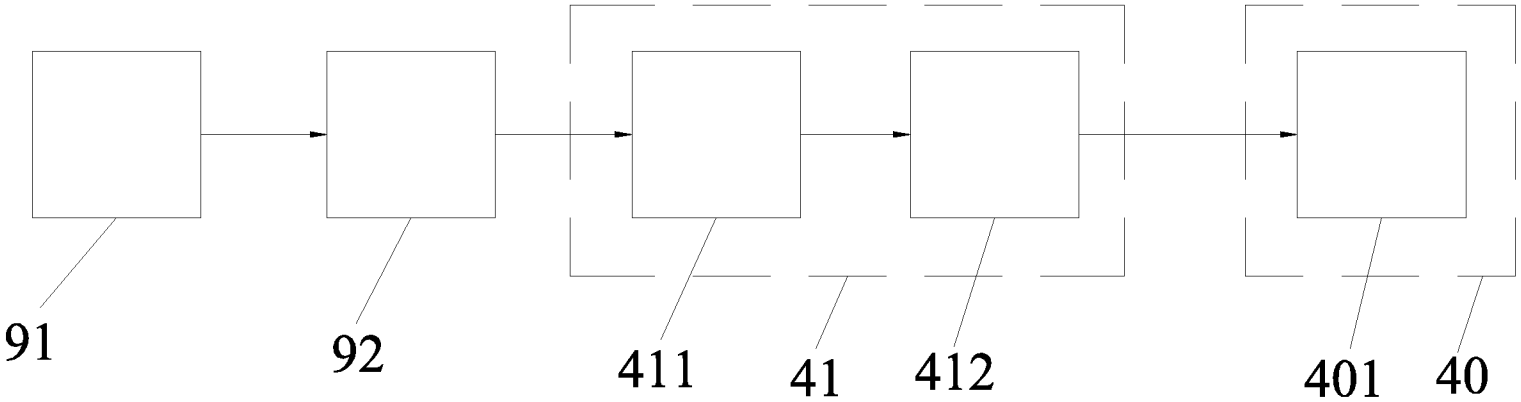
FIG. 6 is a block diagram showing the signal transmission in accordance with the preferred embodiment of the present invention.

Embodiments of the present invention will now be described, by way of example only, with reference to the accompanying drawings.

As shown in FIG. 1 through FIG. 7, the present invention discloses an electret condenser microphone having a low noise figure comprises a housing 10, an electret variable condenser 100, an ASIC (application-specific integrated circuit) amplifier 41, and a dust cover 93. The electret variable condenser 100, the ASIC amplifier 41 and the dust cover 93 are installed in the housing 10. The ASIC amplifier 41 is mounted on a printed circuit board 40. An output terminal 401 is disposed on the printed circuit board 40. The electret variable condenser 100 is electrically connected to the ASIC amplifier 41. The ASIC amplifier 41 is electrically connected to the output terminal 401 on the printed circuit board 40. The ASIC amplifier 41 is an integrated chip bonded to the printed circuit board 40. Preferably, the ASIC amplifier 41 is an analog chip or a digital chip.

Figure 7:
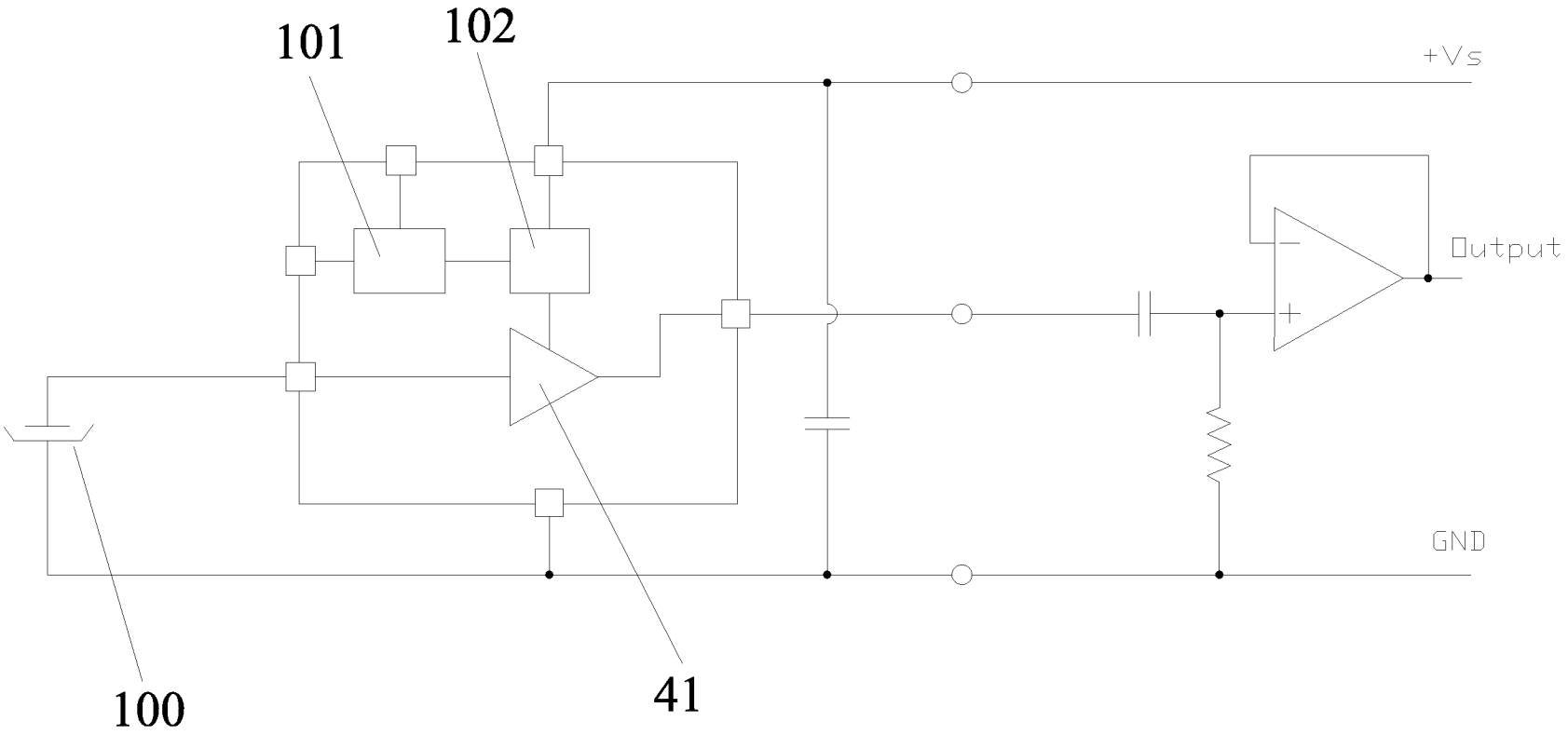
FIG. 7 is a circuit diagram in accordance with the preferred embodiment of the present invention.

As shown in FIG. 7, the printed circuit board 40 is provided with a charge pump 101 and a voltage regulator 102. One end of the electret variable condenser 100 is electrically connected to one end of the charge pump 101 and one end of the voltage regulator 102. Both the end of the charge pump 101 and the end of the voltage regulator 102 are grounded. The end of the voltage regulator 102 is grounded through a first capacitor. Another end of the charge pump 101 is connected to the voltage regulator 102. Another end of the voltage regulator 102 is connected to the ASIC amplifier 41. Both the output terminal 401 on the printed circuit board 40 and another end of the electret variable condenser 100 are grounded. The output terminal 401 of the printed circuit board 40 is further electrically connected to a second capacitor, a resistor, and an operational amplifier.

The electret variable condenser 100 includes a back plate 20, an annular insulating spacer 30, and a diaphragm assembly 70 that can vibrate up and down. The back plate 20 has an electret layer thereon. The housing 10 has a mounting chamber 11 with an opening at one end thereof. Preferably, the opening of the mounting chamber 11 faces downward. The electret variable condenser 100 further includes a holder 60 mounted in the mounting chamber 11. The diaphragm assembly 70, the annular insulating spacer 30, the back plate 20, and the dust cover 93 are all installed in the mounting chamber 11 from the opening. The printed circuit board 40 is mounted in the mounting chamber 11 and covers the opening.

The annular insulating spacer 30 is disposed between the diaphragm assembly 70 and the back plate 20, so that the diaphragm assembly 70 and the back plate 20 are separated to form a sound chamber for collecting sound. The dust cover 93 is disposed above the diaphragm assembly 70 and covers a fourth sound hole 12 to prevent dust from entering the inside of the microphone through the fourth sound hole 12. The dust cover 93 is made of a metal material, and adopts a microporous sound-passing design to satisfy the functions of waterproof and dustproof for the microphone. Besides, the shielding function can be taken into consideration, and the shielding effect can be improved greatly.

The holder 60 is disposed between the printed circuit board 40 and the annular insulating spacer 30. Preferably, the holder 60 is disposed above the printed circuit board 40. The printed circuit board 40 is provided with a third sound hole 94. The holder 60 has a back plate mounting portion 61, a damping plate mounting portion 62, a first spring mounting hole 63, and a second spring mounting hole 64. The first spring mounting hole 63 and the second spring mounting hole 64 are located at the center of the holder 60. The first spring mounting hole 63 is located above the second spring mounting hole 64.

The first spring mounting hole 63 communicates with the second spring mounting hole 64. The damping plate mounting portion 62 is disposed around the first spring mounting hole 63. The back plate mounting portion 61 is disposed around the damping plate mounting portion 62. The back plate 20 is mounted to the back plate mounting portion 61. The annular insulating spacer 30 is press-fitted between the holder 60 and the diaphragm assembly 70.

The back plate 20 is provided with a first sound hole 21. The holder 60 is provided with a second sound hole 65. The first sound hole 21 is in communication with the second sound hole 65. The first sound hole 21 and/or the second sound hole 65 are provided with a damping plate 50. Preferably, the first sound hole 21 is in communication with the second sound hole 65 through the damping plate mounting portion 62.

In this embodiment, the underside of the holder 60 is recessed to form an annular groove 66. The annular groove 66 is disposed around the second spring mounting hole 64. The ASIC amplifier 41 is disposed on the upper end surface of the printed circuit board 40, and the ASIC amplifier 41 is located in the annular groove 66.

The upper and lower ends of a conductive member 80 are connected to the back plate 20 and the ASIC amplifier 41, respectively. The printed circuit board 40 has an output terminal 401. The output terminal 401 is electrically connected to the ASIC amplifier 41. In the embodiment, the ASIC amplifier 41 has a signal amplifying module 411 and a filtering module 412. The signal amplifying module 411 is connected to the conductive member 80 and the filtering module 412. The filtering module 412 is electrically connected to the output terminal 401 of the printed circuit board 40.

In this embodiment, the electret variable condenser 100 is electrically connected to the ASIC amplifier 41 through the conductive member 80. The conductive member 80 is mounted in the housing 10. The conductive member 80 includes a first spring 81, a second spring 82 and a contact electrode 83. The holder 60 has a first spring mounting hole 63 and a second spring mounting hole 64. The first spring mounting hole 63 is located above the second spring mounting hole 64. The first spring mounting hole 63 is in communication with the second spring mounting hole 64.

The contact electrode 83 is disposed in the second spring mounting hole 64 and extends into the first spring mounting hole 63. The first spring 81 is mounted in the first spring mounting hole 63. Two ends of the first spring 81 are connected to the electret variable condenser 100 and the contact electrode 83, respectively. Specifically, the two ends of the first spring 81 are connected to the back plate 20 and the contact electrode 83, respectively. The second spring 82 is mounted in the second spring mounting hole 64. Two ends of the second spring 82 are connected to the printed circuit board 40 and the contact electrode 83, respectively. The ASIC amplifier 41 is electrically connected to the second spring 82.

A method for producing an electret condenser microphone having a low noise figure comprises the following steps:

(1) a preparation step: preparing a housing 10, an electret variable condenser 100, and an ASIC amplifier 41, wherein the ASIC amplifier 41 is bonded to a printed circuit board 40 by a COB (chip-on-board) technology;

(2) an assembly step: installing the electret variable condenser into the housing 10, and installing the ASIC amplifier 41 and the printed circuit board 40 into the housing 10, wherein the ASIC amplifier 41 is electrically connected to the electret variable condenser 100.

In this embodiment, in the preparation step, an adhesive is first dispensed on the printed circuit board 40, the ASIC amplifier 41 is adhered to the printed circuit board 40, and then the terminals of the ASIC amplifier 41 are wired to the wires and soldering board on the printed circuit board 40. After the wiring is completed, the printed circuit board 40 is dispensed with sealing glue and fmally baked and cured. It should be noted that the printed circuit board 40 needs to be cleaned before dropping the adhesive on the printed circuit board 40. After cleaning, the printed circuit board 40 still has oily or oxide layer and other unclean portions. The printed circuit board 40 should be cleaned with a brush or blown with an air gun before the next process. For anti-static products, it is necessary use an ion blower for cleaning the printed circuit board 40. The purpose of cleaning is to clean the dust and oil on the printed circuit board 40 to improve the bonding quality.

The purpose of dispensing adhesion is to prevent the ASIC amplifier 41 from falling off during the delivery and bonding process of a product. In a chip on board (COB) process, needle transfer and pressure injection are usually adopted, wherein the needle transfer obtains a drop of adhesive from a container and dispenses the adhesive onto the printed circuit board 40, and thus it is a very fast glue dispensing method; and the pressure injection puts the adhesive into an injector and applies a specific air pressure to squeeze out the adhesive, wherein the size of the adhesive point is determined by the diameter of a nozzle of the injector and the intensity of pressure and related to the viscosity, so that this technology is generally used in adhesive dispensing machines or automated die bond equipment. The size and height of adhesive drops depend on the type, size and weight of the ASIC amplifier 41. Large and heavy ASIC amplifiers 41 require a larger quantity of adhesive drops, but the size is preferably not too large and should be able to provide sufficient viscosity. In the meantime, the adhesive should not contaminate the bonding wires and soldering board. Preferably, the adhesive is red glue.

During the process of adhering the ASIC amplifier 41 onto the printed circuit board 40, a vacuum suction pen (or a suction nozzle) with a small hardness is required (or a cotton stick is used for the adhesion). The diameter of the suction nozzle depends on the size of the ASIC amplifier 41, and the nozzle tip must be smooth to prevent scratching the surface of the ASIC amplifier 41. During the adhesion process, it is necessary to check the model of the ASIC amplifier 41 and the printed circuit board 40 and confirm the correct adhering direction.

The adhesion of the ASIC amplifier 41 onto the printed circuit board 40 must be "Flat, Stable, and Precise", wherein "Flat" refers to a flat connection between the ASIC amplifier 41 and the printed circuit board 40 without any gap; "Stable" refers to the secured connection between the ASIC amplifier 41 and the printed circuit board 40 during the whole manufacturing process; and "Precise" refers to the precise attachment of the ASIC amplifier 41 with the printed circuit board 40 at the reserved position without any deviation or twisting. It is noteworthy that the ASIC amplifier 41 should not be adhered in the opposite (or wrong) direction.

Black adhesive is used as the sealing glue, and the black adhesive is completely covered on and bonded to an aluminum wire of the ASIC amplifier 41, and the wire should not be exposed. If there is any adhesive leakage, a piece of cloth can be used to wipe it off immediately. During the whole adhesive dispensing process, the nozzle or cotton stick should not touch the ASIC amplifier 41 and the bonded wire. After baking, no air hole is allowed on the surface of the black glue, and no non-solidified black glue is allowed. The height of the black glue is preferably not greater than 1.8 MM, and should be less than 1.5 MM. The temperature of the preheating board and the baking temperature of the adhesive sealing process should be controlled strictly. The adhesive sealing generally adopts needle transfer and pressure injection and occasionally uses a dispensing machine (with a higher cost and a lower efficiency). In general, cotton sticks or syringes are used for dispensing the adhesive, but the operators must have skillful operation ability and require strict processes, since rework of a chip is very difficult.

In a bonding process, defectives such as broken wire, coiled wire, and non-wetting which may lead to a failure of the ASIC amplifier 41, so that the chip-scale package needs performance tests. The testing method can be mainly divided into non-contact testing (examination) method and contact testing (examination) method, and the non-contact testing method has been developed from manual visual inspection to automatic optical image (AOI) analysis and X-ray analysis, and from external circuit pattern inspection to inner-layer solder joint inspection, and developed in the direction of inspecting quality control combined with defective repair separately.

Although the bonder is equipped with the automatic bond quality monitor (BQM) function, yet the BQM function of the bonder mainly adopts design rule check (DRC) and graphic identification. The DRC inspects the quality of the soldered wires according to a predetermined rule (such as a melting point smaller than the melting point of the wire or greater than that specified by a predetermined standard). The graphic identification compares a stored digitized image with the actual work. However, both DRC and graphic identification are affected by process control, process specification, parameter change, and other related factors. A specific method is selected according to the specific conditions of each production line and products. Regardless of what conditions, the visual inspection is always the basic inspection method.

In the preparation step, a holder 60 is further prepared. The holder 60 has a back plate mounting portion 61, a damping plate mounting portion 62, a first spring mounting hole 63, and a second spring mounting hole 64. The electret variable condenser 100 includes a back plate 20, an annular insulating spacer 30, and a diaphragm assembly 70 that can vibrate up and down. The housing 10 has a mounting chamber 11 with an opening at one end thereof. The opening of the mounting chamber 11 faces downward.

In the assembling step, after the housing 10 is inverted, the diaphragm assembly 70, the annular insulating spacer 30 and the back plate 20 are sequentially installed in the mounting chamber 11 of the housing 10. The back plate 20 is positioned to the back plate mounting portion 61. The printed circuit board 40 is mounted in the mounting chamber 11, and the printed circuit board 40 covers the opening.

In this embodiment, the electret variable condenser 100 is electrically connected to the ASIC amplifier 41 through a conductive member 80. The conductive member 80 is mounted in the housing 10. The conductive member 80 includes a first spring 81, a second spring 82, and a contact electrode 83.

In the assembly step, the contact electrode 83 is mounted in the second spring mounting hole 64 and extends into the first spring mounting hole 63. The first spring 81 is mounted in the first spring mounting hole 63 of the holder 60. One end of the first spring 81 is connected to the contact electrode 83. Then, the holder 60, the contact electrode 83 and the first spring 81 are mounted in the mounting chamber 11 of the housing 10. The back plate 20 is positioned to the back plate mounting portion 61. Another end of the first spring 81 is connected to the back plate 20 and the back plate 20 is pressed downward, so that the back plate 20, the annular insulating spacer 30 and the diaphragm assembly 70 are in close contact with each other.

After the second spring 82 is mounted in the second spring mounting hole 64, the printed circuit board 40 is mounted in the mounting chamber 11 of the housing 10. Two ends of the second spring 82 are connected to the printed circuit board 40 and the contact electrode 83, respectively. Finally, the peripheral edge of the upper end of the housing 10 is bent inward to form a projecting portion 95, so that the printed circuit board 40, the conductive member 80, the back plate 20, the annular insulating spacer 30, and the diaphragm assembly 70 are secured in the housing 10.

Next, the working principle is briefly described below. An immovable electrode plate (back plate 20), a movable electrode plate (diaphragm assembly 70), and an annular insulating spacer 30 constitute a flat condenser with the air as a medium, and it is a variable condenser. The electret material is charged to establish an internal electric field. For the flat condenser, there is the following relationship: $V=Q/C$; $C=\varepsilon \cdot S/d$ (wherein V: voltage; Q: charge amount; C: electrostatic capacity; ε: dielectric coefficient; S: area of the electrodes; d: the distance between the electrodes). When the diaphragm assembly 70 is subjected to the action of a sound signal 91, the diaphragm assembly 70 generates vibrations, thereby changing the distance between the diaphragm assembly 70 and the back plate 20 to bring a change of Δd. It can be seen from the formula that the change of Δd brings a change of ΔC.

Because the charge is invariable, the change of ΔC brings a change of ΔV. This initially completes a conversion from the sound signal 91 to an electrical signal 92.

Since the capacitive reactance of the variable condenser is high, the converted electrical signal 92 cannot be directly transmitted to the circuit on the printed circuit board 40. Therefore, the initially obtained electrical signal 92 is conducted to the signal input terminal of the ASIC amplifier 41 on the printed circuit board 40 via the conductive member 80 (the conductive member includes the first spring 81, the second spring 82, and the contact electrode 83). The electrical signal 92 is processed by the signal amplifying module 411 and the filtering module 412 integrated in the ASIC amplifier 41, and then the clean and useful electrical signal 92 that has been amplified is output through the output terminal 401 of the printed circuit board 40 for the next amplification circuitry of the client side.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electret condenser microphone, comprising a housing, an electret variable condenser, and an ASIC (application-specific integrated circuit) amplifier; the electret variable condenser and the ASIC amplifier being installed in the housing, the ASIC amplifier being mounted on a printed circuit board, an output terminal being disposed on the printed circuit board; the electret variable condenser being electrically connected to the ASIC amplifier, the ASIC amplifier being electrically connected to the output terminal on the printed circuit board;

wherein the electret variable condenser includes a back plate, an annular insulating spacer, and a diaphragm assembly that can vibrate up and down, the back plate has an electret layer thereon; the housing has a mounting chamber with an opening at one end thereof, the diaphragm assembly, the annular insulating spacer and the back plate are all mounted in the mounting chamber from the opening, the printed circuit board is mounted in the mounting chamber and covers the opening; the annular insulating spacer is disposed between the diaphragm assembly and the back plate so that the diaphragm assembly and the back plate are separated to form a sound chamber for collecting sound; wherein the electret variable condenser further includes a holder mounted in the mounting chamber, the holder is disposed between the printed circuit board and the annular insulating spacer, the holder has a back plate mounting portion, the back plate is mounted to the back plate mounting portion, and the annular insulating spacer is press-fitted between the holder and the diaphragm assembly; and, wherein the back plate is provided with a first sound hole, the holder is provided with a second sound hole, the first sound hole is in communication with the second sound hole, and at least one of the first sound hole and the second sound hole is provided with a damping plate.

2. The electret condenser microphone as claimed in claim 1, wherein the ASIC amplifier is an integrated chip bonded to the printed circuit board.

3. The electret condenser microphone as claimed in claim 1, wherein the electret variable condenser is electrically connected to the ASIC amplifier through a conductive member, the conductive member is mounted in the housing, the conductive member includes a first spring, a second spring and a contact electrode, two ends of the first spring are connected to the electret variable condenser and the contact electrode respectively, two ends of the second spring are connected to the printed circuit board and the contact electrode respectively, and the ASIC amplifier is electrically connected to the second spring.

4. The electret condenser microphone as claimed in claim 1, wherein the printed circuit board is provided with a charge pump and a voltage regulator, one end of the electret variable condenser is electrically connected to one end of the charge pump and one end of the voltage regulator, the end of the charge pump and the end of the voltage regulator are grounded, the end of the voltage regulator is grounded through a first capacitor, another end of the charge pump is connected to the voltage regulator, another end of the voltage regulator is connected to the ASIC amplifier, the output terminal on the printed circuit board and another end of the electret variable condenser are grounded; and the output terminal of the printed circuit board is further electrically connected to a second capacitor, a resistor, and an operational amplifier.

5. A method for producing the electret condenser microphone as claimed in claim 1, comprising:

(1) a preparation step: preparing the housing, the electret variable condenser and the ASIC amplifier, wherein the ASIC amplifier is bonded to the printed circuit board by a COB (chip-on-board) technology;

(2) an assembly step: installing the electret variable condenser into the housing, and installing the ASIC amplifier and the printed circuit board into the housing, wherein the ASIC amplifier is electrically connected to the electret variable condenser;

wherein in the preparation step, a holder is further prepared, the holder has a back plate mounting portion, the electret variable condenser includes a back plate, an annular insulating spacer and a diaphragm assembly that can vibrate up and down, the housing has a mounting chamber with an opening at one end thereof;

in the assembling step, the diaphragm assembly, the annular insulating spacer and the back plate are sequentially installed in the mounting chamber of the housing, the back plate is positioned to the back plate mounting portion, the printed circuit board is mounted in the mounting chamber, and the printed circuit board covers the opening; and wherein the electret variable condenser is electrically connected to the ASIC amplifier through a conductive member, the conductive member is mounted in the housing, the conductive member includes a first spring, a second spring and a contact electrode;

in the assembly step, the contact electrode is first mounted in a second spring mounting hole of the holder and extends into a first spring mounting hole of the holder, the first spring is mounted in the first spring mounting hole of the holder, one end of the first spring is connected to the contact electrode, the holder, the contact electrode and the first spring are mounted in the mounting chamber of the housing, the back plate is positioned to the back plate mounting portion, another end of the first spring is connected to the back plate and the back plate is pressed downward, so that the back plate, the annular insulating spacer and the diaphragm assembly are in close contact with each other;

after the second spring is mounted in the second spring mounting hole, the printed circuit board is mounted in the mounting chamber of the housing, two ends of the second spring are connected to the printed circuit board and the contact electrode respectively, finally, a peripheral edge of an upper end of the housing is bent inward to form a projecting portion, so that the printed circuit board, the conductive member, the back plate, the annular insulating spacer and the diaphragm assembly are secured in the housing.

* * * * *